US006525474B1

(12) United States Patent
Feder et al.

(10) Patent No.: US 6,525,474 B1
(45) Date of Patent: Feb. 25, 2003

(54) ELECTRIC LAMP WITH SEALS AT PLASTICALLY DEFORMED CURRENT CONDUCTORS

(75) Inventors: Reiner Feder, Simmerath (DE); Wolfgang M. Ollesch, Merzenrich-Gibelsrath (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/522,718

(22) Filed: Mar. 10, 2000

(30) Foreign Application Priority Data

Mar. 19, 1999 (EP) ..... 99200869

(51) Int. Cl.[7] ..... H01J 17/18; H01J 61/36; H01J 5/48; H01J 5/50

(52) U.S. Cl. ..... 313/623; 313/624; 313/625; 313/318.12

(58) Field of Search ..... 313/623, 624, 313/625, 318.07, 318.1, 318.12

(56) References Cited

U.S. PATENT DOCUMENTS 4,254,356 A * 3/1981 Karikas ..... 174/50.64
5,527,199 A * 6/1996 Feder et al. ..... 29/860
5,905,338 A * 5/1999 Verspaget et al. ..... 313/318.13
5,936,349 A * 8/1999 Fukai et al. ..... 313/623
5,984,749 A * 11/1999 Nishibori et al. ..... 445/26

FOREIGN PATENT DOCUMENTS

GB 721621 1/1955 ..... 36/39

* cited by examiner

*Primary Examiner*—Nimeshkumar D. Patel
*Assistant Examiner*—Matt Hodges
(74) *Attorney, Agent, or Firm*—Dicran Halajian; Frank J. Keegan

(57) ABSTRACT

The electric lamp comprises a lamp vessel (1) and an electric element (4). The electric element (4) is electrically connected to the outside via a current feedthrough that comprises an outer current conductor (7). By a plastic deformation (12) of the outer current conductor (7), e.g. flattening, it is interlocked in the wall (2) of the lamp vessel (1) and the durability of the current feedthrough of the lamp against a mechanical load is improved.

2 Claims, 1 Drawing Sheet

ELECTRIC LAMP WITH SEALS AT PLASTICALLY DEFORMED CURRENT CONDUCTORS

BACKGROUND OF THE INVENTION

The invention relates to an electric lamp comprising:

a light-transmissive lamp vessel sealed in a vacuumtight manner, with a quartz glass wall enclosing a space accommodating an electric element which is connected via an inner current conductor projecting from the wall of the lamp vessel into the space to a metal foil completely embedded in the wall;

at least an outer current conductor having a first end, a second end and a diameter, said first end being connected to the metal foil and being at least substantially completely enclosed by the wall of the lamp vessel, and said second end projecting from the wall to the exterior;

an anchored part comprising a deformed portion of the first end of the outer current conductor in co-operation with the enclosing wall.

A lamp of this type is known from DE-C-1 016 848 to which GB 721,621 corresponds. In the manufacture of the lamp, a seal is made and one or more of the outer current conductors is partly incorporated in the wall. At the area of the seal, the quartz glass is caused to soften in the presence of the metal foil and the outer current conductor which have a connection with each other, for example a weld. The quartz glass reaches a temperature of more than 1900° C. Subsequently, the seal thus formed is cooled. The outer current conductor shrinks due to its relatively high linear coefficient of thermal expansion (approx. $50*10^{-7}$ $K^{-1}$) more strongly than the quartz glass, glass with an $SiO_2$ content of at least 95% by weight (linear coefficient of thermal expansion approximately $6*10^{-7}$ $K^{-1}$) in which it is embedded. A capillary space around this outer current conductor is thus obtained, as a result of which the outer current conductor is incorporated in the wall of the lamp vessel with some freedom of movement. Due to the capillary space around the outer current conductor, the connection between the metal foil and the outer current conductor is the only connection of the outer current conductor with the lamp. In the known lamp, the outer current conductor in the wall of the lamp vessel has an anchored part so that the freedom of movement of the outer current conductor in the wall of the lamp vessel is limited. Consequently, the weak connection between the metal foil and the outer current conductor of the lamp remains at least substantially unloaded in the case of a mechanical load of the outer current conductor. A drawback of the known lamp is that the anchored part of the outer current conductor in the wall of the lamp vessel is obtained by cutting a groove in the first end of the outer current conductor. A drawback of cutting is that it is a cumbersome operation and involves contamination. Further drawbacks of the known lamp are a reduced conductivity and a decrease of the mechanical strength of the outer current conductor due to the groove provided therein.

SUMMARY OF THE INVENTION

It is an object of the invention to provide an electric lamp which has a simple construction and can easily be made, and which obviates the above-mentioned drawbacks.

According to the invention, the deformed portion of the anchored part is a plastically deformed portion of the first end. Plastic deformation of the outer current conductor is an operation which is usually free from loss of material because, generally, material is displaced and, in essence, nothing is removed so that the operation is free from contamination. Plastic deformation may be a relatively simple operation which is cost-effective. The lamp may thus be manufactured in a relatively simple, inexpensive and clean way. The plastically deformed portion has the further advantage that the outer current conductor at the area of the deformed portion has a surface which also defines the maximum conductivity through the outer current conductor, which, in contrast to the known lamp, is at least substantially not reduced.

In a further embodiment, the outer current conductor at the area of the deformed portion has at least two diameters which are mutually different in size. Such an embodiment of the anchored part has the advantage that the outer current conductor is limited in its freedom of movement also as regards a torsion load of the outer current conductor.

In a favorable embodiment, the anchored part comprises a flattened portion of the first end. The outer current conductor with a flattened portion can easily be formed with a satisfactorily reproducible quality in one rapid stroke by means of (possibly profiled) dies. Since the occurrence of, for example, a sharp kink in the first end is thus prevented, the risk of breakage is relatively small, which is an advantage.

In another embodiment, the anchored part comprises a bent portion of the first end. The anchored part with a bent portion is an alternative to the anchored part with a flattened portion and can also be made easily and rapidly. Moreover, the anchored part with the bent portion has the advantage that the risk of longitudinally splitting the material of the outer current conductor, as may occur, for example, during flattening, is further reduced.

The preferred embodiment of the lamp, i.e. an anchored part with a flattened or a bent portion, is dependent on the sensitivity of the material of the outer current conductor to breakage or splitting during plastic deformation of the outer current conductor.

DETAILED DESCRIPTION OF THE PREFERRED EMBODIMENTS

Figure 1:
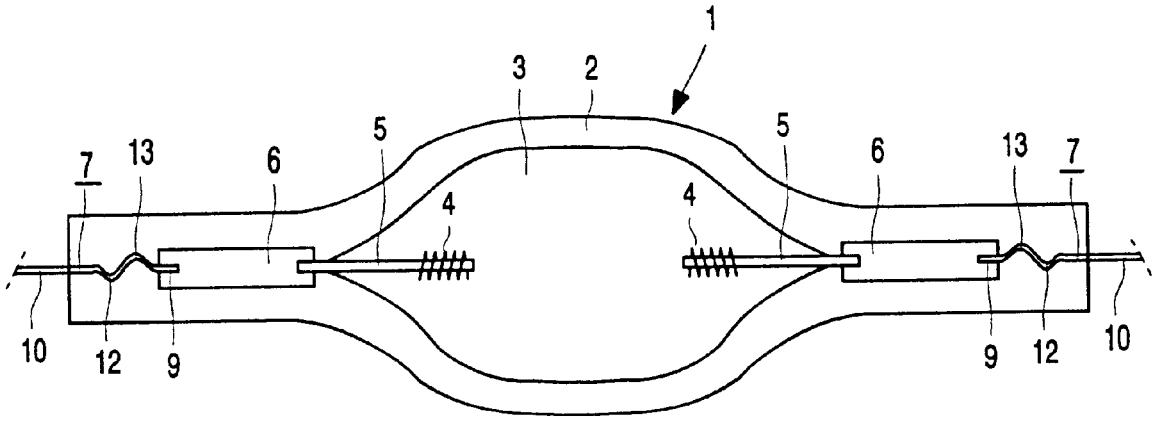
FIG. 1 is a plan view of a lamp according to the invention.

In FIG. 1, the electric lamp is a high-pressure gas discharge lamp and has a lamp vessel 1 which is closed in a vacuumtight manner and a quartz glass wall 2 enclosing a space 3. The electric element 4, a pair of electrodes in the Figure, is connected via a relevant inner current conductor 5 projecting from the wall 2 of the lamp vessel 1 into the space 3 to a relevant one of the metal foils 6, made of Mo with 0.5% by weight of $Y_2O_3$ in the Figure. The metal foils 6 are embedded in the wall 2 of the lamp vessel 1 and connected, i.e. welded in the Figure, to a respective outer current conductor 7, of molybdenum in FIG. 1. Each outer current conductor 7 comprises a first end 9 and a second end 10 which is connected to the relevant metal foil 6. The inner current conductors 5 and the electric element 4 are made of tungsten and may have a small content of additives for regulating the crystal growth of tungsten, such as a total of 0.01% by weight of K, Al and Si, and 1.5% by weight of $ThO_2$ .

Each outer current conductor 7 comprises an anchored part 12 which is completely enclosed by the wall 2 of the lamp vessel 1. The anchored bent part 12 is a sine-shaped bent portion in the lamp of FIG. 1 but may alternatively have a differently curved shape in other embodiments of the lamp. An ionizable filling is present in the space 3. In FIG. 1, the lamp vessel 1 is filled with mercury, rare gas and halides of dysprosium, holmium, gadolinium, neodymium and cesium. The lamp of FIG. 1 had a power consumption of 700 W during operation. A large mechanical tensile and/or torsion load can be exerted on the outer current conductor 7, while the risk of breakage of the connection between the metal foil 6 and the outer current conductor 7 and consequent premature failure of the lamp is relatively small.

In the embodiment shown, the outer current conductor 7 has a diameter of approximately 1 mm. The bent portion 12 has a sine shape with an amplitude 13 of approximately 500 $\mu$m.

Figure 2:
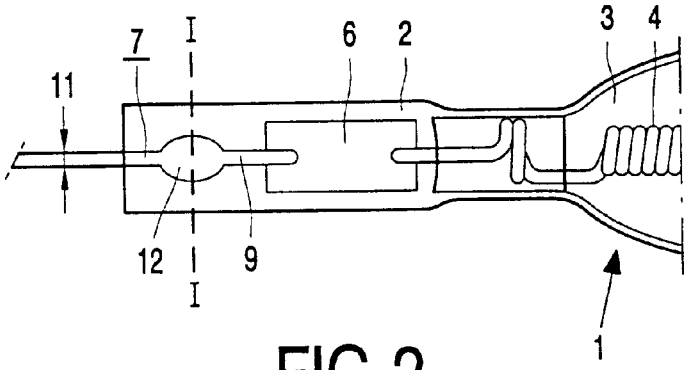
FIG. 2 shows a detail of the lamp with an anchored part comprising a flattened portion.

FIG. 2 shows a detail of a lamp which, in the space 3, is provided with a halogen filling and a filament such as the electric element 4. The outer current conductors 7 have an anchored part 12 in the first end 9, each anchored part comprising a flattened portion. By flattening, the diameter 11 is changed in the flattened portion 12 of the outer current conductor 7. This change of diameter in the flattened portion 12 is such that a strong anchorage of the outer current conductor 7 is obtained in co-operation with the enclosing wall 2 of the lamp vessel 1. Due to this firm anchorage, the connection between the outer current conductor 7 and the metal foil 6 remains at least substantially unloaded when exerting tensile forces and/or torsion forces on the outer current conductor 7.

Figure 3:
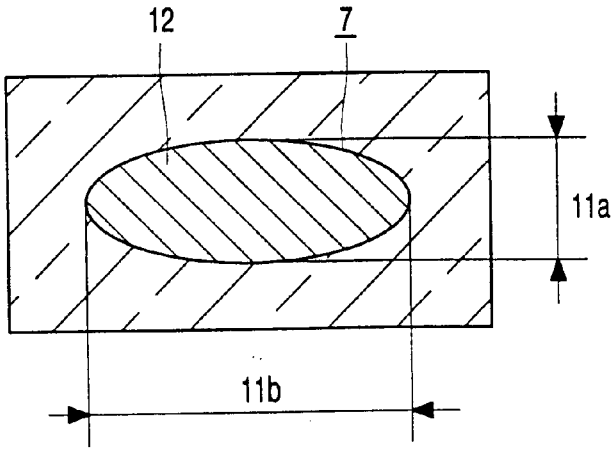
FIG. 3 is a cross-section taken on the line I—I of the anchored part in FIG. 2.

FIG. 3 is a cross-sectional view of the anchored part of FIG. 2, taken on the line I—I. The Figure shows that the outer current conductor 7 has two different diameters 111*a* and 11*b* in the flattened portion 12. The outer current conductor 7 has an undeformed diameter of approximately 700 $\mu$m. The local change of diameter obtained by flattening, which, dependent on the direction of observation is an increase of the diameter or a decrease of the diameter, is approximately 300 $\mu$m. The shape of the cross-section of the anchored part 12 is substantially elliptical, having a length of 100 $\mu$m and a width of 400 $\mu$m.

The protective scope of the invention is not limited to the embodiments described. The invention resides in each and every novel characteristic feature and each and every combination of characteristic features. Reference numerals in the claims do not limit their protective scope. The use of the word "comprise" does not exclude the presence of elements other than those mentioned in the claims. The use of the word "a" or "an" preceding an element does not exclude the presence of a multitude of such elements.

What is claimed is:

1. An electric lamp comprising:

a light-transmissive lamp vessel sealed in a vacuumtight manner, with a wall enclosing a space accommodating an electric element which is connected via an inner current conductor projecting from the wall of the lamp vessel into the space to a foil completely embedded in the wall;

at least an outer current conductor for receiving power having a first end, a second end and a diameter, said first end being connected to the foil at a connection and being at least substantially completely enclosed by the wall of the lamp vessel, said second end projecting from the wall to the exterior; and an anchored part comprising a plastically deformed portion of the first end of the outer current conductor in co-operation with the wall, said plastically deformed portion extending from said connection; the anchored part comprising a bent portion of the first end.

2. An electric lamp comprising:

a light-transmissive lamp vessel sealed in a vacuumtight manner, with a quartz glass wall enclosing a space accommodating an electric element which is connected via an inner current conductor projecting from the wall of the lamp vessel into the space to a metal foil completely embedded in the wall;

at least an outer current conductor for receiving power having a first end, a second end and a diameter, said first end being connected to the metal foil at a connection and being at least substantially completely enclosed by the wall of the lamp vessel, and said second end projecting from the wall to the exterior; and an anchored part comprising a plastically deformed portion of the first end of the outer current conductor in co-operation with the enclosing wall, said plastically deformed portion extending from said connection; the anchored part comprising a bent portion having a substantially sinusoidal shape.

* * * * *